US007856669B2

(12) United States Patent
Sommers et al.

(10) Patent No.: US 7,856,669 B2
(45) Date of Patent: Dec. 28, 2010

(54) WEATHER RESISTANT TEXTILE ARTICLE

(75) Inventors: Steven L. Sommers, Coral Gables, FL (US); Daniel H. Moss, Coral Springs, FL (US); Morrie Siegel, Miami, FL (US); Randolph Loew, Glen Ridge, NJ (US)

(73) Assignee: Go! Products, LLC, Coral Gables, FL (US)

( * ) Notice: Subject to any disclaimer, the term of this patent is extended or adjusted under 35 U.S.C. 154(b) by 236 days.

(21) Appl. No.: 10/853,961

(22) Filed: May 26, 2004

(65) Prior Publication Data

US 2005/0273902 A1 Dec. 15, 2005

(51) Int. Cl.
*A41D 3/04* (2006.01)

(52) U.S. Cl. ..... 2/87; 2/93; 2/97; 428/96

(58) Field of Classification Search ..... 2/87, 2/88, 135, 115; 428/96.198, 32
See application file for complete search history.

(56) References Cited

U.S. PATENT DOCUMENTS

| | | | | |
|---|---|---|---|---|
| 2,222,782 | A | 11/1940 | Moses | |
| 2,466,911 | A | 4/1949 | Raymond | 154/46 |
| 2,556,621 | A | 6/1951 | Higgins | 2/87 |
| 2,756,431 | A | 7/1956 | De Luca, Jr. et al. | 2/87 |
| 2,967,306 | A | 1/1961 | Fabanich | 2/94 |
| 3,541,620 | A | 11/1970 | Chapuis | 5/343 |
| 3,563,842 | A | 2/1971 | Thomas | 161/92 |
| 3,665,518 | A | 5/1972 | Leadford | 2/88 |
| 3,946,443 | A | 3/1976 | Knight | 2/82 |
| 4,079,466 | A * | 3/1978 | Rosenstein | 2/87 |
| 4,194,041 | A * | 3/1980 | Gore et al. | 442/289 |
| 4,390,096 | A | 6/1983 | Goldenberg | 206/390 |
| 4,641,381 | A * | 2/1987 | Heran et al. | 2/400 |
| 4,783,856 | A | 11/1988 | Bouwens et al. | 2/87 |
| 4,868,928 | A * | 9/1989 | Norvell | 2/272 |
| 5,204,156 | A * | 4/1993 | Lumb et al. | 428/96 |
| 5,354,587 | A * | 10/1994 | Abayasekara | 428/36.6 |

(Continued)

FOREIGN PATENT DOCUMENTS

EP 0657279 A1 * 12/1994

(Continued)

OTHER PUBLICATIONS

Tensile Strength Test website printout, "Tensile Strength Test-Grab Test ASTM D 5034-95 (Reapproved 2001) Standard Test Method for Breaking Strength and Elongation of Text Fabrics (Grab Test)", found at http://216.239.39.104/search?q=cache: TNJQXympJMIJ:fp.uni.edu/tapp/pdf%2520files/Te..., pp. 1-2.

(Continued)

*Primary Examiner*—Katherine Moran
*Assistant Examiner*—Richale L Quinn
(74) *Attorney, Agent, or Firm*—MacCord Mason PLLC

(57) ABSTRACT

A weather resistant textile article comprising: a primary outer shell having an edge at least partially defining an opening for wearing the article; and a moisture wicking lining attached to at least the primary outer shell. In the preferred embodiment, the article includes a secondary outer shell attached to the primary outer shell. Also, in the preferred embodiment, the article includes a moisture permeable adhesive layer joining the shell and the lining.

21 Claims, 8 Drawing Sheets

U.S. PATENT DOCUMENTS

| | | | | |
|---|---|---|---|---|
| 5,409,761 | A | 4/1995 | Lnagley | 428/198 |
| 5,560,974 | A | 10/1996 | Langley | 428/198 |
| 5,592,690 | A | 1/1997 | Wu | 2/67 |
| 5,720,045 | A * | 2/1998 | Aldridge | 2/81 |
| 6,117,800 | A * | 9/2000 | Seibert et al. | 442/77 |
| 6,235,662 | B1 * | 5/2001 | Zehnder | 442/223 |
| 6,325,127 | B1 | 12/2001 | Waldrop | 156/510 Q |
| 6,427,242 | B1 * | 8/2002 | Bush et al. | 2/69 |
| 6,511,927 | B1 * | 1/2003 | Ellis et al. | 442/77 |
| 2003/0106130 | A1 * | 6/2003 | Reynolds | 2/69 |
| 2003/0215617 | A1 * | 11/2003 | Shehata et al. | 428/196 |

FOREIGN PATENT DOCUMENTS

| | | |
|---|---|---|
| WO | WO 03/046270 | 6/2003 |

OTHER PUBLICATIONS

Branson Plastics Joining website print out, "Textiles & Films", found at http://www.branson-plasticsjoin.com/applications_textile.asp, Copyright Branson Ultrasonics Corporation, updated as of Jan. 11, 2006, pp. 1-4.

Clopay Plastic Products-Elastomerics and Laminates, undated information from the internet, admitted prior art.

Clopay Plastic Products-Clopay Comfort Films; undated information from the internet, admitted prior art.

Clopay Plastic Products-Breathables Monolithic; undated info. from the internet, admitted prior art.

Clopay Plastics Products-Breathables Microporus; undated info. from the internet, admitted prior art.

Clopay Plastics Products-Breathables Apertured; undated info. from the internet, admitted prior art.

Derek Duck; information from the internet; undated, possible prior art.

Frogg Toggs; information from the internet; undated, possible prior art.

* cited by examiner

WEATHER RESISTANT TEXTILE ARTICLE

BACKGROUND OF THE INVENTION (1) Field of the Invention

The present invention relates generally to weather resistant textile articles, and, more specifically, to a weather resistant textile article comprising a primary outer shell having an opening for wearing the article; and a moisture wicking lining attached to the primary outer shell.

(2) Description of the Prior Art

For people attending outdoor activities, it is often desirable to carry along lightweight, water repellant ponchos or other articles, such as pants, just in case a rain shower approaches during the event. Existing ponchos are often effective for keeping the wearer sheltered from the elements, but are not breathable. Thus, the wearer becomes wet nonetheless from his or her own perspiration.

Thus, there remains a need for a new and improved textile article that is strong, lightweight, and at the same time, water-repellant and breathable.

SUMMARY OF THE INVENTION

The present invention is directed to a weather resistant textile article comprising: a primary outer shell having an edge at least partially defining an opening for wearing the article; and a moisture wicking lining attached to at least the primary outer shell. In the preferred embodiment, the article includes a secondary outer shell attached to the primary outer shell. Also, in the preferred embodiment, the article includes a moisture permeable adhesive layer joining the shell and the lining.

In the preferred embodiment, the primary outer shell of the article may be print-receptive. The primary outer shell may include a water resistant material. The primary outer shell may be non-elastic for strength and leak resistance. The primary outer shell may include a polymer. The polymer may be polypropylene. The article may have a moisture vapor transport (MVT) value between about 1200 and about 1600. Preferably, the article has a moisture vapor transport (MVT) value of about 1400. The primary outer shell may be a film. The film may include a plurality of interior pores, each at least partially defining an aperture in the film. Each of the plurality of interior pores may at least partially define an aperture between about 0.4 microns diameter and about 0.6 microns diameter. Preferably, each of the plurality of interior pores at least partially defines an aperture about 0.5 microns diameter.

In the preferred embodiment, the moisture-wicking layer may be non-elastic. The moisture-wicking layer may include a polymer. The polymer may be polypropylene. The polymer may be non-woven. The non-woven polymer may be spun bonded. The moisture permeable adhesive layer of the article may have a cover factor of between about 40 and 60 percent. Preferably, the moisture permeable adhesive layer has a cover factor of about 50 percent.

In the preferred embodiment, the article may include a tortuous path welded seam connecting the primary outer shell and the secondary outer shell. The tortuous path welded seam may be ultrasonically bonded. The secondary outer shell may include a hood. The secondary outer shell may include an arm. The secondary outer shell may include a leg.

Accordingly, one aspect of the present invention is to provide a weather resistant textile article comprising: a primary outer shell having an edge at least partially defining an opening for wearing the article; and a moisture wicking lining attached to the primary outer shell.

Another aspect of the present invention is to provide a weather resistant textile article comprising: a primary outer shell having an edge at least partially defining an opening for wearing the article; a moisture wicking lining attached to the primary outer shell; and a moisture permeable adhesive layer joining the shell and the lining.

Still another aspect of the present invention is to provide a weather resistant textile article comprising: a primary outer shell having an edge at least partially defining an opening for wearing the article; a secondary outer shell attached to the primary outer shell; a moisture wicking lining attached to at least the primary outer shell; and a moisture permeable adhesive layer joining the shell and the lining.

These and other aspects of the present invention will become apparent to those skilled in the art after a reading of the following description of the preferred embodiment when considered with the drawings.

DESCRIPTION OF THE PREFERRED EMBODIMENTS

Figure 1:
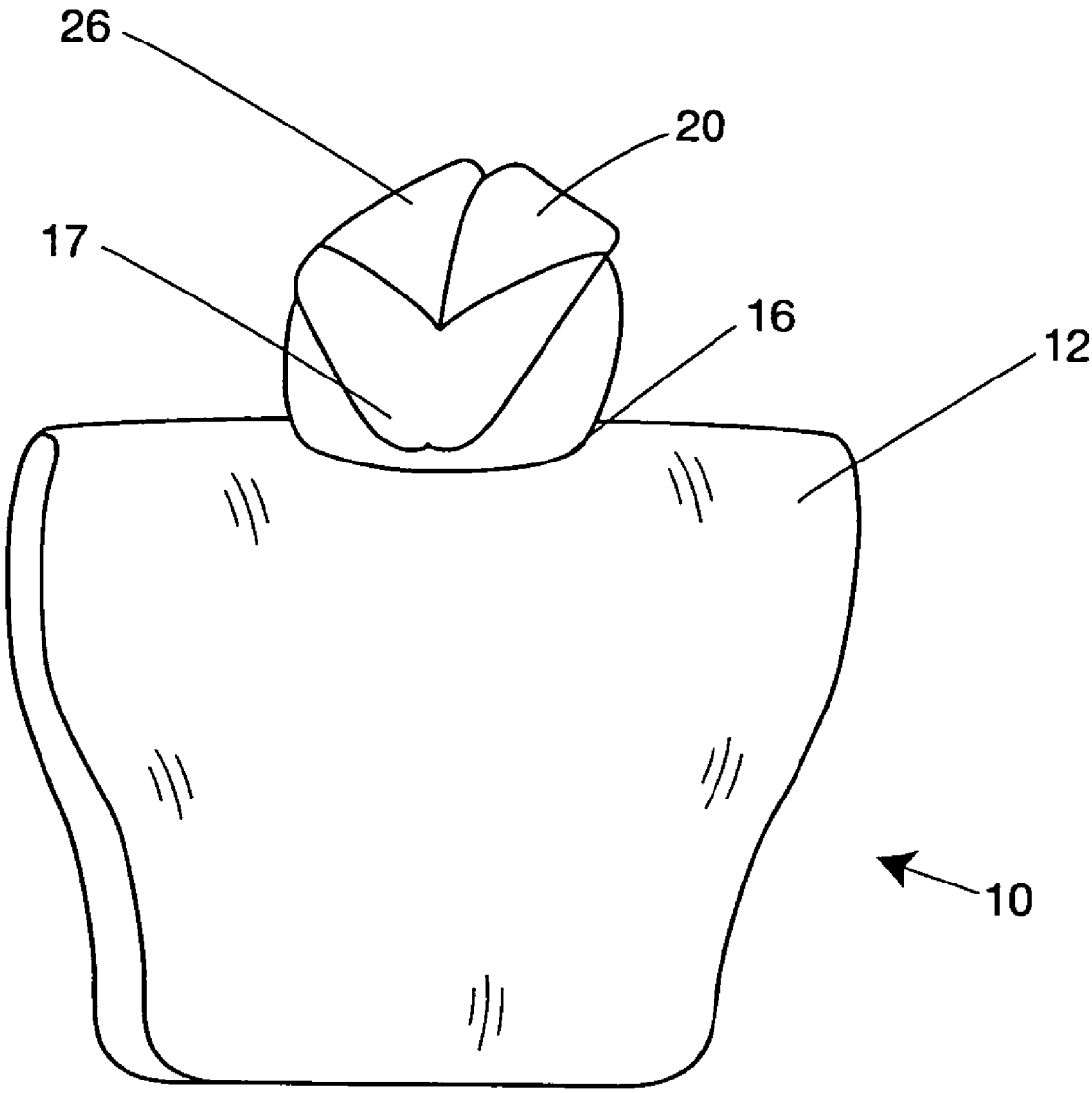
FIG. 1 is a front perspective view of a weather resistant textile article constructed according to the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 2:
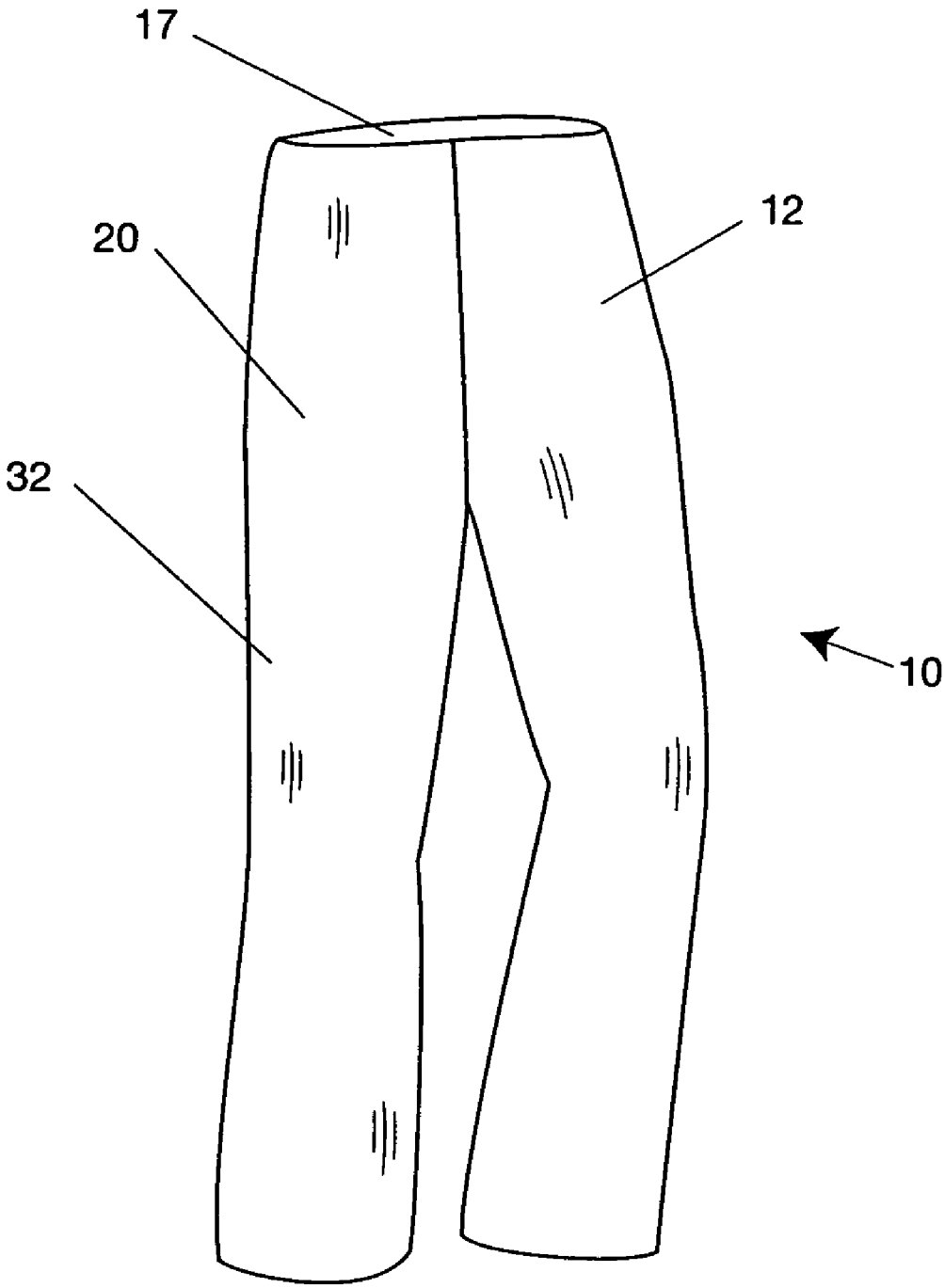
FIG. 2 is a front perspective view of another embodiment of the weather resistant textile article.
Figure 3:
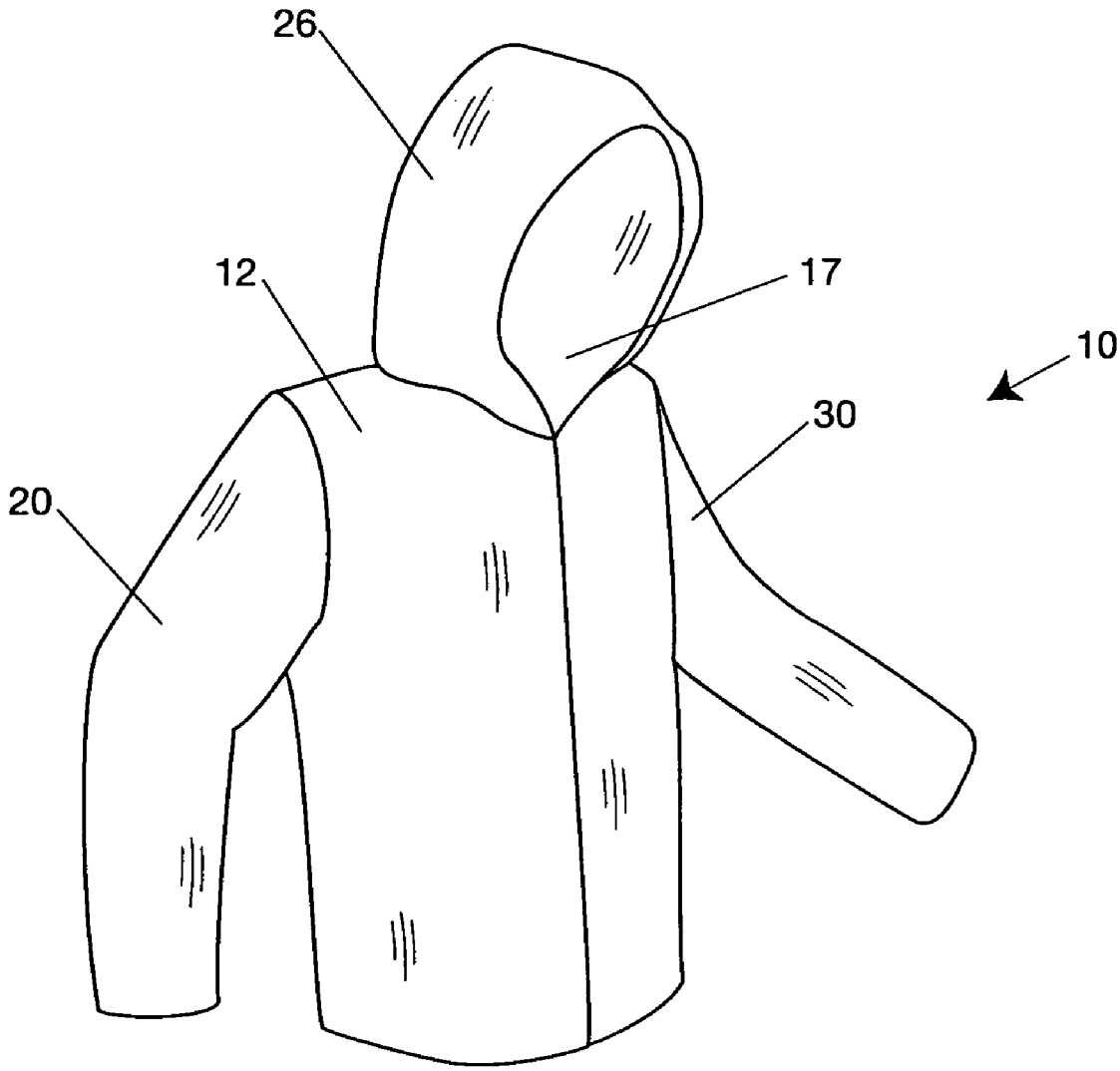
FIG. 3 is yet another embodiment of the weather resistance textile article.

Referring now to the drawings in general and FIG. 1 in particular, the illustrations are for the purpose of describing a preferred embodiment of the invention and are not intended to limit the invention thereto. As best seen in FIG. 1, a weather resistant textile article, generally designated 10, is shown constructed according to the present invention. The weather resistant textile article 10 comprises a primary outer shell 12 having an edge 16 at least partially defining an opening 17 for wearing the article 10. The weather resistant textile article 10 also includes a moisture wicking lining attached to at least the primary outer shell 12 with a moisture permeable adhesive layer. The weather resistant textile article 10 also includes a secondary outer shell 20 attached to the primary outer shell 12 with a tortuous path welded seam. The secondary outer shell 20 may be a hood 26, or, as shown in FIG. 2, a leg 32, or arm 30, shown in FIG. 3. The article 10 has a moisture vapor transport (MVT) value between about 1400 and about 1600. Preferably, the article has a MVT of about 1400.

Figure 4:
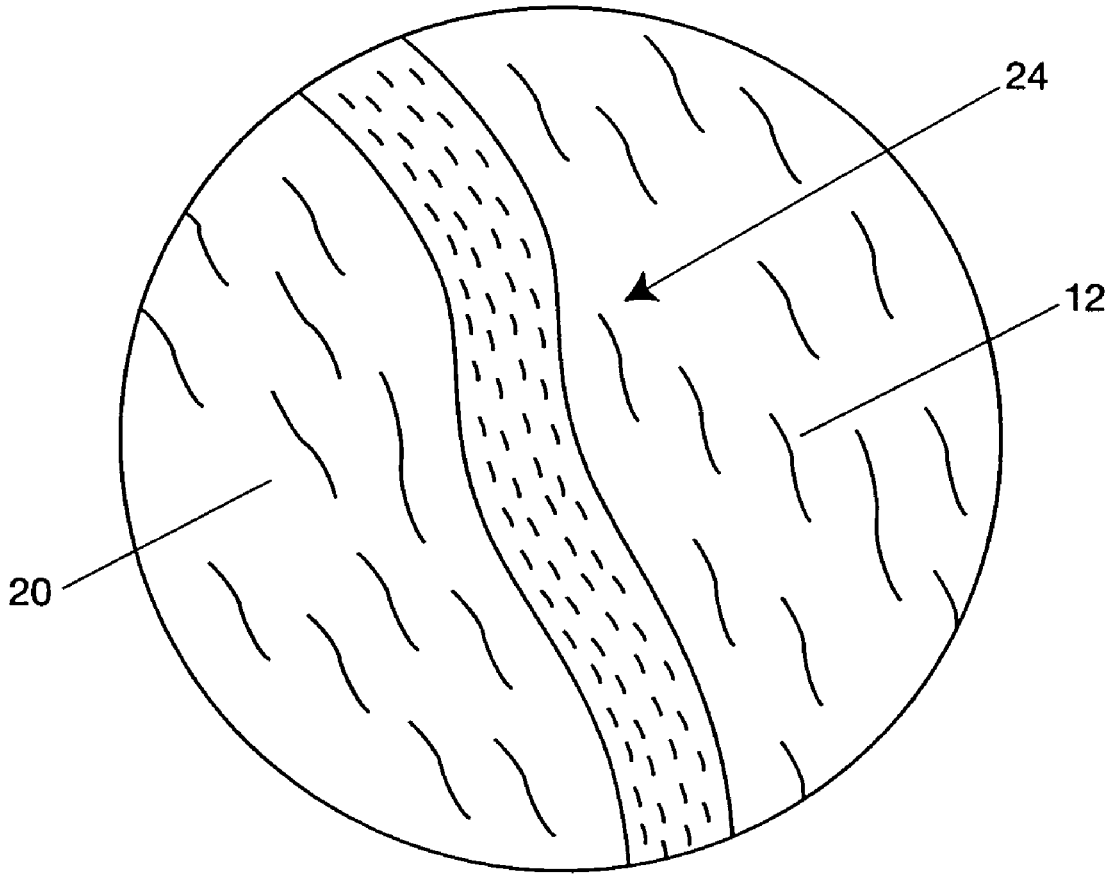
FIG. 4 is a top perspective view of a seam for the weather resistant textile article.

FIG. 4 shows a tortuous path welded seam 24 connecting the primary outer shell 12 with the secondary outer shell 20. The tortuous path welded seam 24 is ultrasonically bonded using a typical horn and anvil multi-row application machine. The seam 24 produces a tortuous path of travel for deterring water or other elements from breaching the seam.

Figure 5:
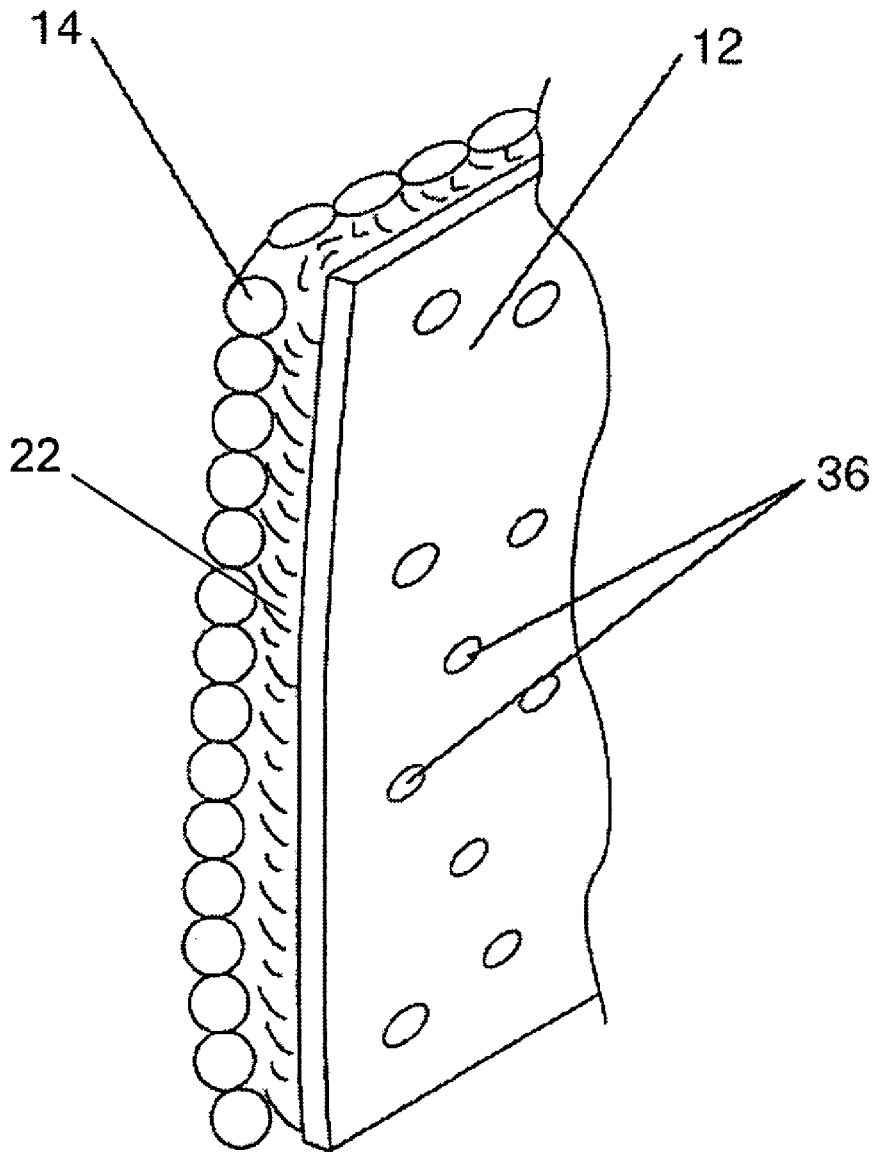
FIG. 5 is a side perspective view of a primary outer shell, a moisture wicking lining and a moisture permeable adhesive layer for the weather resistant textile article.

FIG. 5 is an enlarged cross-section of the outer primary outer shell 12, the moisture wicking lining 14 attached to the primary outer shell 12, and the moisture permeable adhesive layer 22 joining the shell 12 and the lining 14. The primary outer shell 12 is print receptive to accommodate decorative printing on the article. The primary outer shell 12 includes a water resistant material for preventing water or other elements from penetrating the outer shell 12. The primary outer shell 12 is a non-elastic polymer film for providing adequate strength and water resistance. In the preferred embodiment, the polymer film is a polypropylene. However, other suitable films are Teflon®, polyvinyl chloride, polyurethane, polyethylene, polyester and mixtures thereof. One such film/fabric which is particularly suitable is manufactured by Medtecs of Taiwan, R.O.C. and is available from Satesa Corporation of Englewood, N.J. under the designation MEDLON-50GSM.

The film includes a plurality of pores 36, each of which at least partially define an aperture in the film for allowing vapor to pass through the film. The pore size of the film before lamination is between about 1 and 7 microns with an average pore size of about 5 microns. Following lamination, the plurality of interior pores at least partially defines an aperture of between about 0.4 microns diameter and about 0.6 microns diameter. Preferably, each of the plurality of interior pores at least partially defines an aperture of about 0.5 microns diameter when tested according to ASTM F-316-1989 for the 50 gms/$m^2$ breathable fabric primary outer shell 12.

The moisture-wicking lining 14 is non-elastic and includes a polymer. In the preferred embodiment, the polymer is treated with a hydrophilic surfactant. Preferably, the polymer is a spun bonded, non-woven polypropylene. However, the lining also could be carded chemically bonded, air laid, spun laced, needled or flash bonded. The moisture permeable adhesive layer 22 has a cover factor of between about 40 and 60 percent. Preferably, the moisture permeable adhesive layer 22 has a cover factor of about 50 percent.

Figure 6:
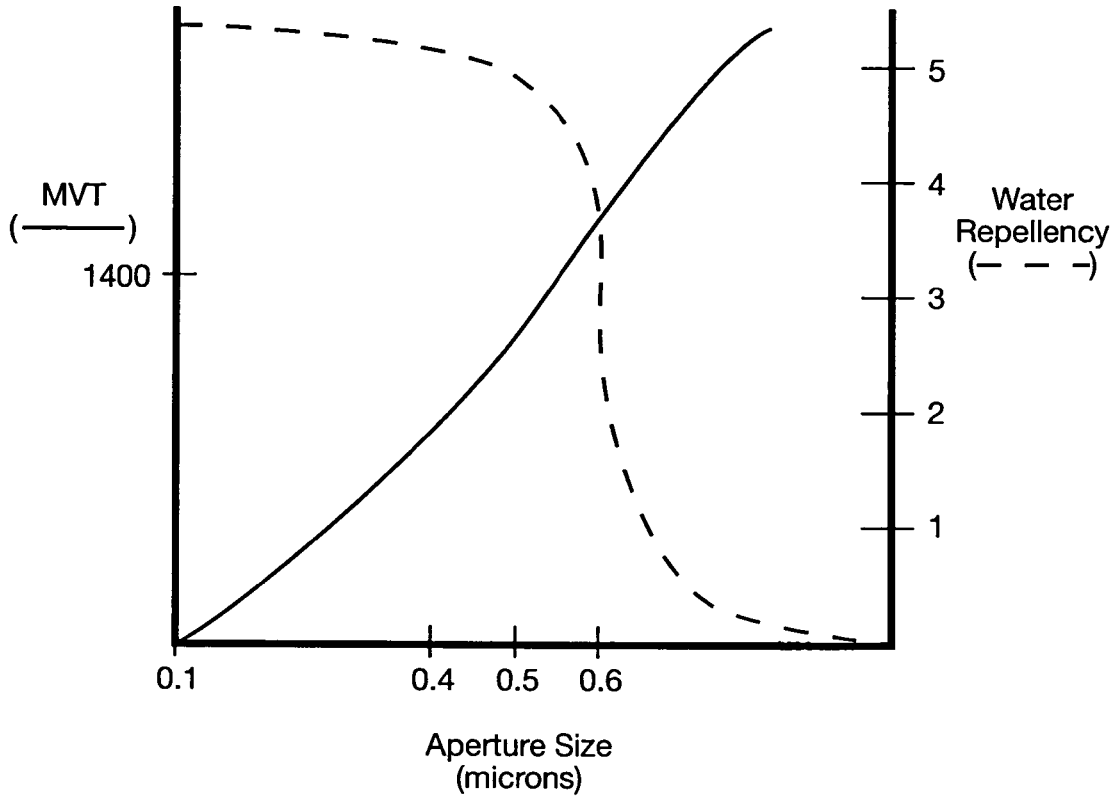
FIG. 6 is a graph showing the relationship between the size of the apertures in the outer layer of the textile article and the MVT and Water Repellency of the article.

FIG. 6 is a graph showing the relationship between the size of the apertures in the outer layer of the textile article and the MVT and water repellency of the article. The MVT value of the article generally increases as the size of the apertures in the outer layer increases. The water repellency of the article decreases relatively gradually as the size of the apertures increases, until the size of the apertures exceeds about 0.5 microns. When the size of the apertures exceeds 0.5 microns, the water repellency begins to decrease. By about 7 microns, the water repellency is substantially lost.

Figure 7:
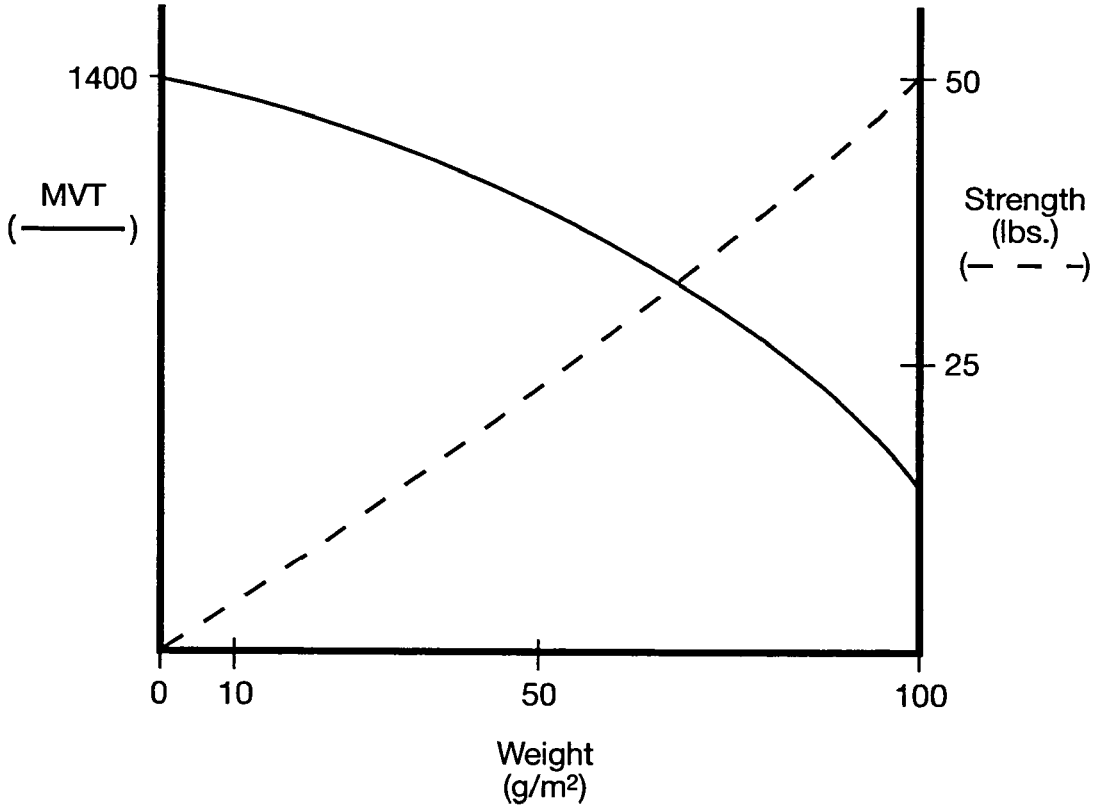
FIG. 7 is a graph showing the relationship between the weight of the textile article and the MVT and Strength of the article.

FIG. 7 is a graph showing the relationship between the weight of the textile article and the MVT value and the tensile strength of the article. The tensile strength of the article generally increases as the weight increases, and the MVT value of the article generally decreases as the weight of the article increases. The tensile strength of the article was measured according to ASTM D 5034-95.

Figure 8:
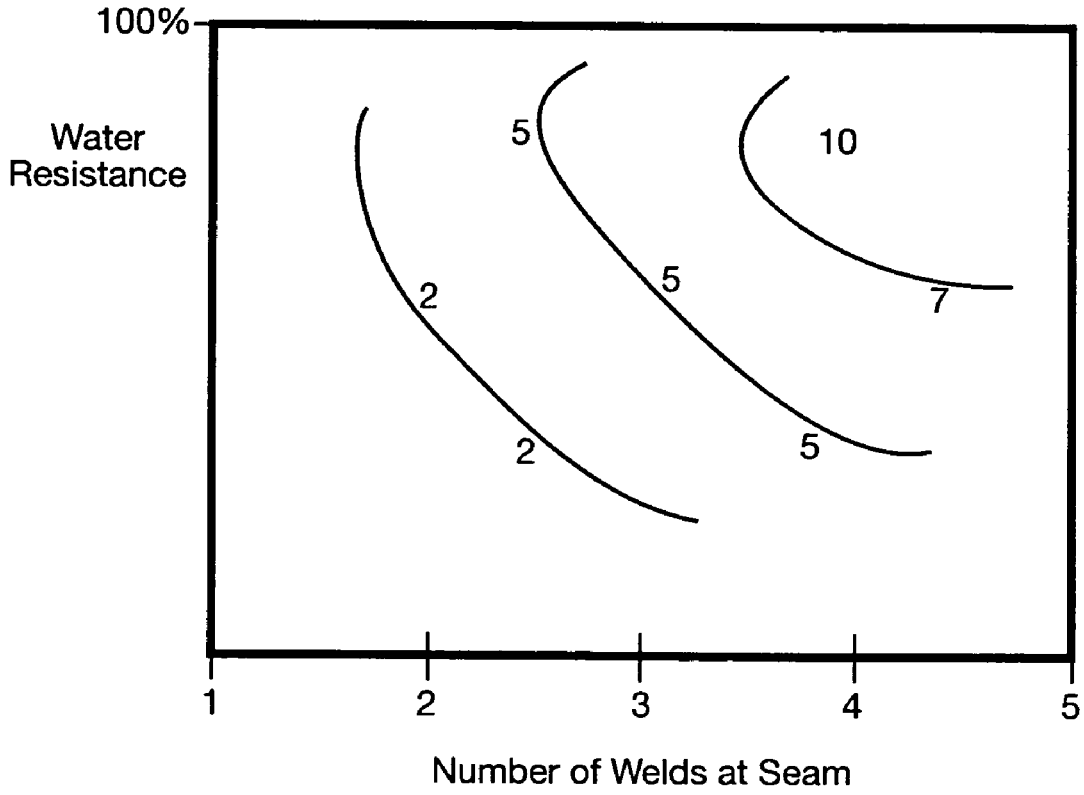
FIG. 8 is a graph showing the strength of the seams of the textile article as a function of the Number of Welds at Seam and the Water Resistance of the article.

FIG. 8 is a graph showing the strength of the seams of the textile article as a function of the number of welds at the seam and the water resistance of the article. The seam strength is the tensile strength at the seams of the article measured according to ASTM D 5034-95. The seam strength of the article generally increases as the number of welds at the seams of the article is increased. The water resistance of the seam also generally increases as the number of welds at the seams of the article increases.

Certain modifications and improvements will occur to those skilled in the art upon a reading of the foregoing description. By way of example, while the moisture permeable adhesive layer is a patterned layer of adhesive, other suitable methods of joining the lining and the shell, such as by using an adhesive that is itself moisture permeable, are available. All such modifications and improvements have been deleted herein for the sake of conciseness and readability but are properly within the scope of the following claims.

We claim:

1. A weather resistant textile article comprising:

(a) a primary outer shell consisting of a microporous film forming the exterior surface of the article;

(b) a secondary outer shell attached to the primary outer shell, said secondary outer shell forming a structure selected from the group consisting of a hood, legs, arms and combinations thereof;

(c) a moisture wicking lining forming the interior surface of the article attached to at least the primary outer shell, said moisture wicking lining treated with a hydrophilic surfactant; and (d) a moisture permeable adhesive layer joining the primary outer shell and directly to the moisture wicking lining.

2. The article according to claim 1, further including a tortuous path welded seam connecting the primary outer shell and the secondary outer shell.

3. The article according to claim 2 wherein the tortuous path welded seam is ultrasonically bonded.

4. The article according to claim 1 wherein the secondary outer shell is a microporous film forming the exterior surface of the article.

5. The article according to claim 1 wherein the secondary outer shell is coplanar with the primary outer shell.

6. The article according to claim 1 wherein the primary outer shell is print-receptive.

7. The article according to claim 1 wherein the primary outer shell is non-elastic for strength and leak resistance.

8. The article according to claim 7 wherein the primary outer shell includes a polymer.

9. The article according to claim 8 wherein the polymer is polypropylene.

10. The article according to claim 1 wherein the article has a moisture vapor transport (MVT) value between about 1200 and about 1600.

11. The article according to claim 10 wherein the article has a moisture vapor transport (MVT) value of about 1400.

12. The article according to claim 1 wherein the moisture-wicking lining is non-elastic.

13. The article according to claim 1 wherein the moisture-wicking lining includes a polymer.

14. The article according to claim 13 wherein the polymer is polypropylene.

15. The article according to claim 13 wherein the polymer is non-woven.

16. The article according to claim 15 wherein the non-woven polymer is spun bonded.

17. The article according to claim 1 wherein the moisture permeable adhesive layer has a cover factor of between about 40 and 60 percent.

18. The article according to claim 17 wherein the moisture permeable adhesive layer has a cover factor of about 50 percent.

19. The article according to claim 1 wherein the film foaming the primary outer shell includes a plurality of interior pores, each at least partially defining an aperture in the film.

20. The article according to claim 19 wherein each of the plurality of interior pores at least partially defines an aperture between about 0.4 microns diameter and about 0.6 microns diameter.

21. The article according to claim 20 wherein each of the plurality of interior pores at least partially defines an aperture about 0.5 microns diameter.

* * * * *

UNITED STATES PATENT AND TRADEMARK OFFICE

CERTIFICATE OF CORRECTION

PATENT NO. : 7,856,669 B2
APPLICATION NO. : 10/853961
DATED : December 28, 2010
INVENTOR(S) : Sommers et al.

It is certified that error appears in the above-identified patent and that said Letters Patent is hereby corrected as shown below:

In Column 4, Line 30, "and" should be deleted after the word shell

Signed and Sealed this
Thirty-first Day of May, 2011

David J. Kappos

David J. Kappos
*Director of the United States Patent and Trademark Office*